US007399101B2

(12) United States Patent
Clausen et al.

(10) Patent No.: US 7,399,101 B2
(45) Date of Patent: Jul. 15, 2008

(54) LIGHTED PLIER HAND TOOL APPARATUS

(75) Inventors: Eivind Clausen, Bellingham, WA (US); Bill E. Brauner, Los Altos, CA (US)

(73) Assignee: Streamworks, Inc., Livermore, CA (US)

( * ) Notice: Subject to any disclaimer, the term of this patent is extended or adjusted under 35 U.S.C. 154(b) by 0 days.

(21) Appl. No.: 11/486,746

(22) Filed: Jul. 14, 2006

(65) Prior Publication Data

US 2007/0019400 A1 Jan. 25, 2007

Related U.S. Application Data

(60) Provisional application No. 60/701,248, filed on Jul. 20, 2005.

(51) Int. Cl.
*B25B 23/18* (2006.01)
*F21V 33/00* (2006.01)
*B25B 7/02* (2006.01)

(52) U.S. Cl. ..... 362/119; 362/253; 81/423

(58) Field of Classification Search ..... 362/109, 362/119, 120, 253; 383/383; 81/418, 423, 81/900

See application file for complete search history.

(56) References Cited

U.S. PATENT DOCUMENTS 2,854,564 A * 9/1958 Cohen et al. ..... 362/119
5,573,329 A * 11/1996 van Gennep ..... 362/191
5,921,654 A * 7/1999 Coyle ..... 362/120
6,273,582 B1 * 8/2001 Taggart et al. ..... 362/119
6,296,365 B1 10/2001 McCalla et al. ..... 362/119
6,477,925 B2 * 11/2002 Lin ..... 81/423

* cited by examiner

*Primary Examiner*—John A Ward
(74) *Attorney, Agent, or Firm*—Weaver Austin Villeneuve & Sampson LLP

(57) ABSTRACT

A lighted plier hand tool apparatus including a pivoting hub device containing a first opening, an opposed second opening, and a passage therethrough extending from the first opening to the second opening. The plier hand tool apparatus further includes a first plier member and a second plier member. Each plier member includes a respective handle portion, a jaw portion, and an intermediate pivot portion therebetween. Each respective pivot portion defines a respective bore section formed for aligned receipt of the hub device therein. Such receipt interconnects the first and second plier members together to enable relative pivotally movement of the respective jaw portions at a work area between an opened condition and a closed condition. The hand tool apparatus further includes an illumination device having an illumination portion outputting a light beam from one end of an elongated body section. The body section of the assembly is formed and dimensioned for receipt in the passage of the hub device such that the illumination portion terminates at the work area for illumination thereof.

32 Claims, 15 Drawing Sheets

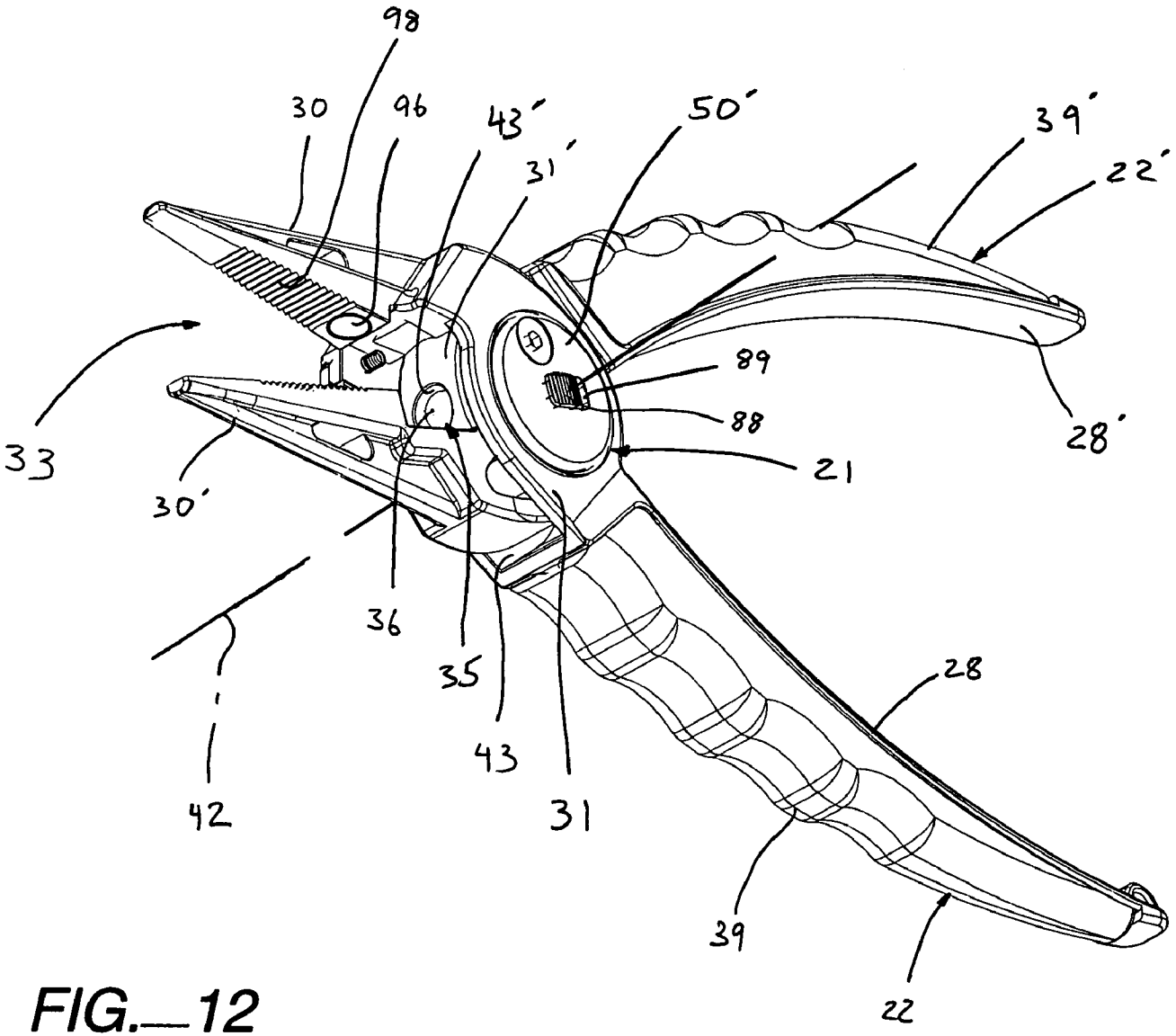
FIG.__12

LIGHTED PLIER HAND TOOL APPARATUS

RELATED APPLICATION DATA

The present application claims priority under 35 U.S.C. §119 to U.S. Provisional application Ser. No. 60/701,248, naming Clausen et al as inventors, filed Jul. 20, 2005, and entitled A LIGHTED PLIER AND TOOL APPARATUS, which is incorporated herein by reference in their entirety and for all purposes.

FIELD OF THE INVENTION

The present invention relates to hand tools, and more particularly, relates to lighted plier hand tool apparatuses.

BACKGROUND OF THE INVENTION

Poorly lit work environments will always pose additional risks to any personnel operating hand tools. This problem is particularly troublesome for industrial application where equipment that is located next to other components that can easily be damaged or that present a hazard to the technician, such as exposed high-voltage sources or heavy equipment.

While external lighting is an obvious solution, it may not always be practical due to space and power source limitations where such tools are to be applied. For example, the external light may require it to be connected to an outlet by an extension cord and that the technician hangs in a position to illuminate the component. Such outlets, of course, are not always located near the equipment that is to be serviced. Furthermore, the light may relatively large so that technicians may not normally carry them when inspecting and adjusting equipment.

Several hand tools have been developed that contain their own light source, instead of depending upon the need for external lighting. The advantage of this approach is that the beam of light contained in the tool generally can be directed at the work area where the technician is performing the work without any additional manipulation and maneuvering of the light source.

One significant problem with most of these lighted hand tool approaches is that either the light generated by the tool is of lower intensity and insufficient, or the addition of the light impair the use of the tool. Generally, a lower intensity light results from the necessity of reducing the power consumption in an effort to reduce the size of the power source, and hence, reduce the tool bulkiness and footprint. In other designs, a lower light intensity is caused by the diffusion of the light when it is required to pass through obstructive structure of the tool itself. Accordingly, there is a need for improved lighted hand tool, such as a lighted plier hand tool, that has a high intensity light source with a low power consumption that will provide illumination directly to the desired work area or object to be grasped by the plier hand tool.

SUMMARY OF INVENTION

The present invention provides a lighted plier hand tool apparatus including a pivoting hub device containing a first opening, an opposed second opening, and a passage therethrough extending from the first opening to the second opening. The plier hand tool apparatus further includes a first plier member and a second plier member. Each plier member includes a respective handle portion, a jaw portion, and an intermediate pivot portion therebetween. Each respective pivot portion defines a respective bore section formed for aligned receipt of the hub device therein. Such receipt interconnects the first and second plier members together to enable relative pivotally movement of the respective jaw portions at a work area between an opened condition and a closed condition. The hand tool apparatus further includes an illumination device having an illumination portion outputting a light beam from one end of an elongated body section. The body section of the assembly is formed and dimensioned for receipt in the passage of the hub device such that the illumination portion terminates at the work area for illumination thereof.

Accordingly, a lighted plier hand tool is provided with an illumination device disposed directly through the hub device. This enables the use of a high intensity LED light beam to directly illuminate the work area from the hub device, while retaining a conventional use and a sleek appearance similar to its non-illuminated counterparts.

In one specific embodiment, at least one of the jaw portions includes a receiving cavity formed and dimensioned for receipt of the illumination portion therein when the respective jaw portions are in the closed condition. Further, each pivot portion of the first plier member and the second plier member includes corresponding passageways extending therethrough for receipt of the illumination device elongated body. One end of each passageway faces toward the work area of the respective jaw while an opposed second end of the passageway faces away from the work area.

In another arrangement, the illumination device includes a shoulder portion at an intersection between the illumination portion and the elongated body. The transverse cross-sectional dimension of the shoulder portion is larger than the passageway of at least one of the pivot portions to prevent passage of the illumination portion therethrough.

In yet another specific embodiment, the hub device includes a first hub section and a second hub section. Each hub section cooperates to collectively define the hub passage when the first hub section is mounted to the second hub section. Further, when the mounted hub sections are positioned in the respective aligned bore sections of the first and second plier members, the pivot portion of the first plier member is pivotally affixed to the pivot portion of the second plier member for relatively pivotal movement of the jaw portions between the opened condition and the closed condition.

In still another embodiment, the direction of the light beam upon the work area can be rotationally adjusted about a longitudinal axis of the hub device. Further, depending upon the illumination source and/or the configuration of the illumination portion, the width of the beam can be adjusted as well. In another embodiment, the distal end of the illumination portion is positioned substantially flush with a distal portion of the pivot portions of the plier members.

In another specific configuration, of the elongated body section of the illumination device defines an upstanding retaining collar, while an interior wall that defines the hub passage includes a corresponding receiving slot. The periphery of the retaining collar and the corresponding receiving slot are non-circular.

Another embodiment includes a battery box of the illumination device, having a battery compartment, enclosed within the interior cavity of the of hub device. The first hub section includes an end cap that defines an access port for access to battery compartment of the battery box. The second hub section includes an end cap supporting a switch device operably coupling the battery box to the LED light source for operation thereof.

In one specific embodiment, a magnetic coupling device is included that cooperates with the respective jaw portions of the first and second plier members to magnetically retain the same together, in the closed condition. The magnetic coupling device includes a first magnet embedded in a work surface of a jaw portion of one of the first and second plier members. The magnet is positioned and configured to cooperate with an opposite work surface of the respective jaw portion for the other of the second and first plier member, in the closed condition. The magnet then cooperates with the magnetically attractive material of the other jaw portion to magnetic retain the jaw portions in the closed condition.

In another aspect of the present invention, a hand operated plier apparatus is provided having a first plier member and a second plier member. Each plier member includes a respective handle portion, a jaw portion, and an intermediate pivot portion therebetween. Moreover, each respective pivot portion interconnects the first and second plier members together for relative pivotally movement of the respective jaw portions between an opened condition and a closed condition. The plier apparatus further includes a magnetic coupling device cooperating with the respective jaw portions of the first and second plier member to magnetically retain the same together, in the closed condition.

BRIEF DESCRIPTION OF THE DRAWINGS

The assembly of the present invention has other objects and features of advantage which will be more readily apparent from the following description of the best mode of carrying out the invention and the appended claims, when taken in conjunction with the accompanying drawing, in which:

FIG. 12 is a top perspective view of the lighted hand tool apparatus of FIG. 11, in the opened condition.

DETAILED DESCRIPTION OF THE INVENTION

Figure 1:
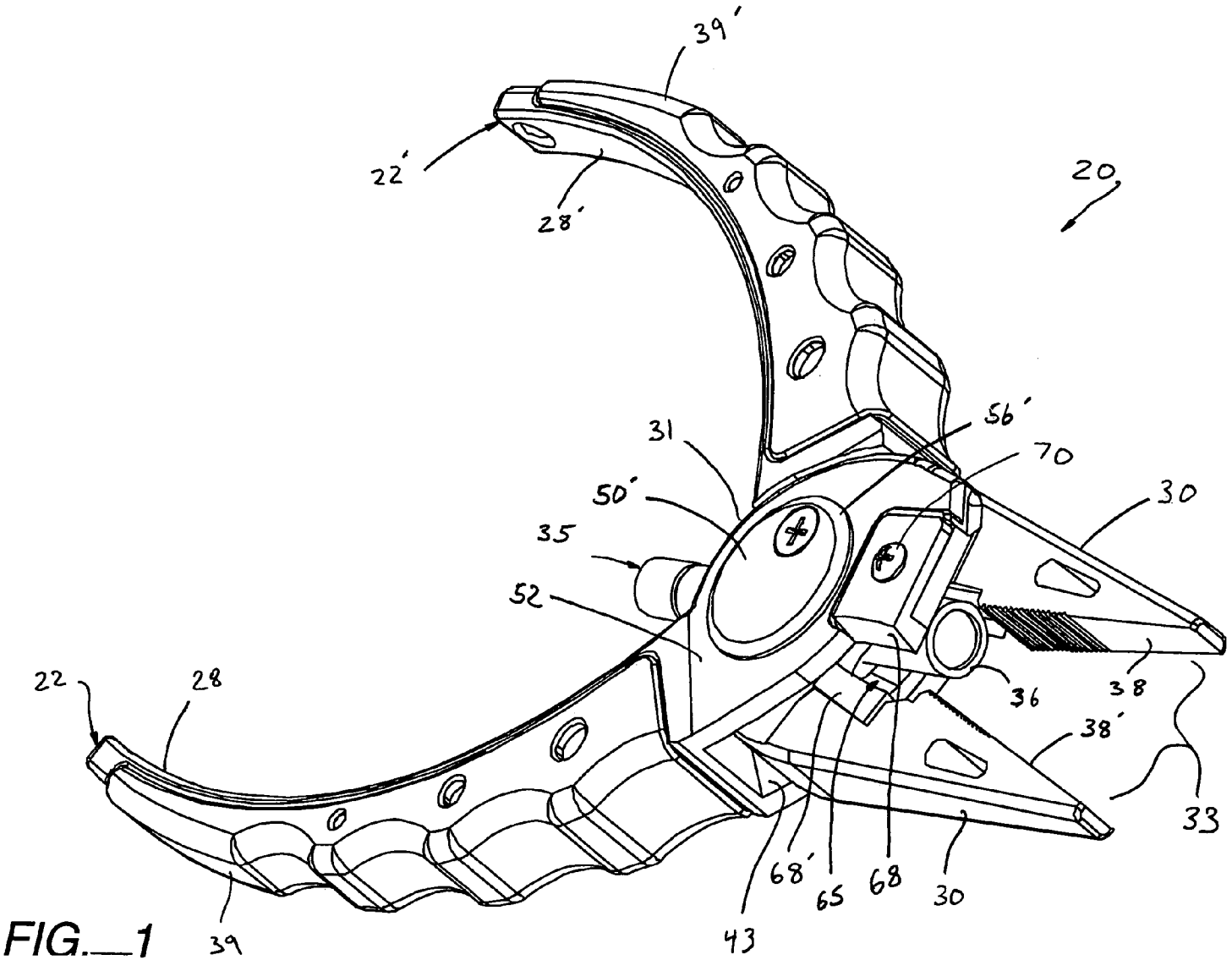
FIG. 1 is a top front perspective view of a lighted hand tool apparatus constructed in accordance with the present invention, illustrated in an opened condition.

While the present invention will be described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims. It will be noted here that for a better understanding, like components are designated by like reference numerals throughout the various figures.

Figure 2:
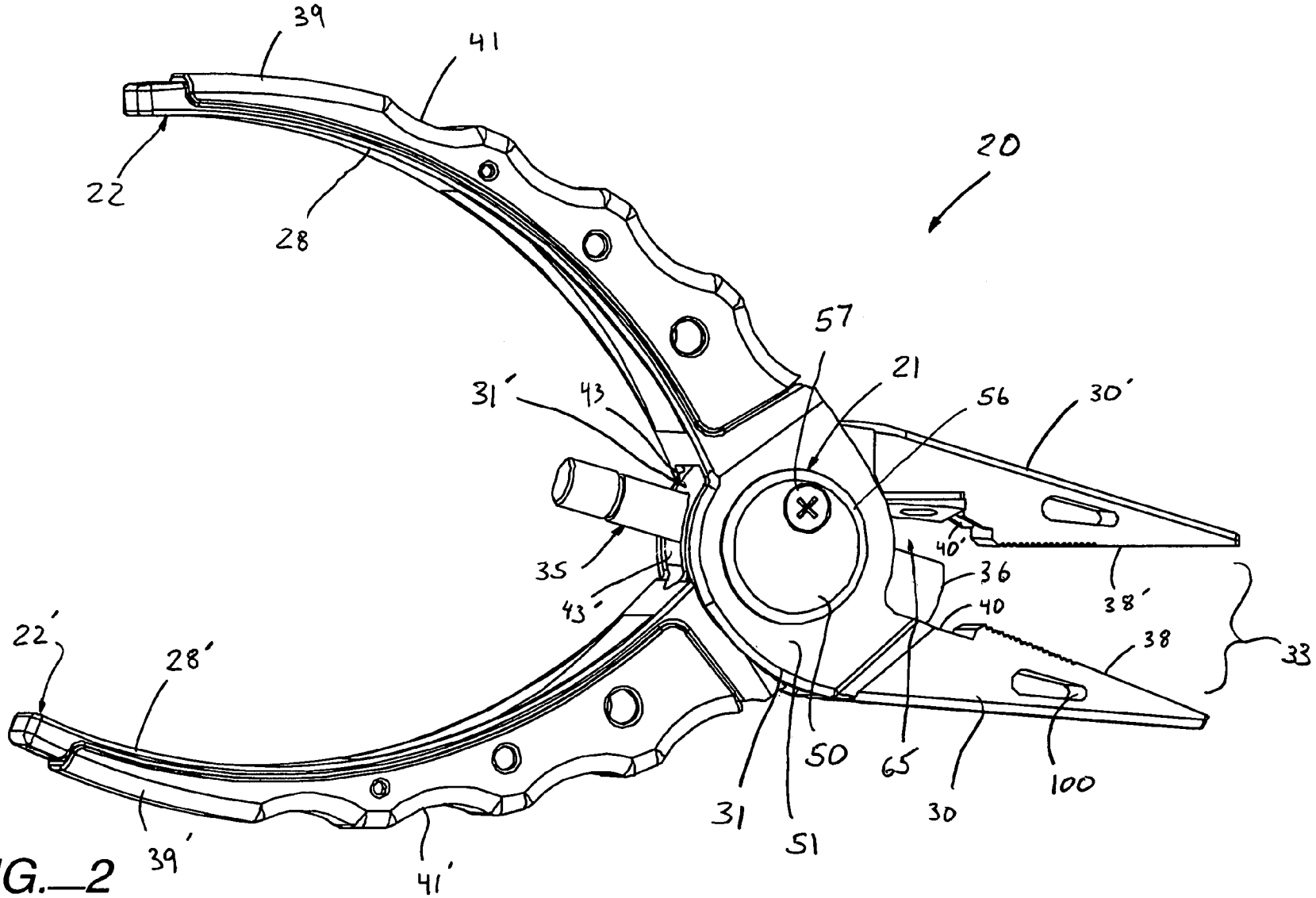
FIG. 2 is a side perspective view of the lighted hand tool apparatus of FIG. 1.
Figure 3:
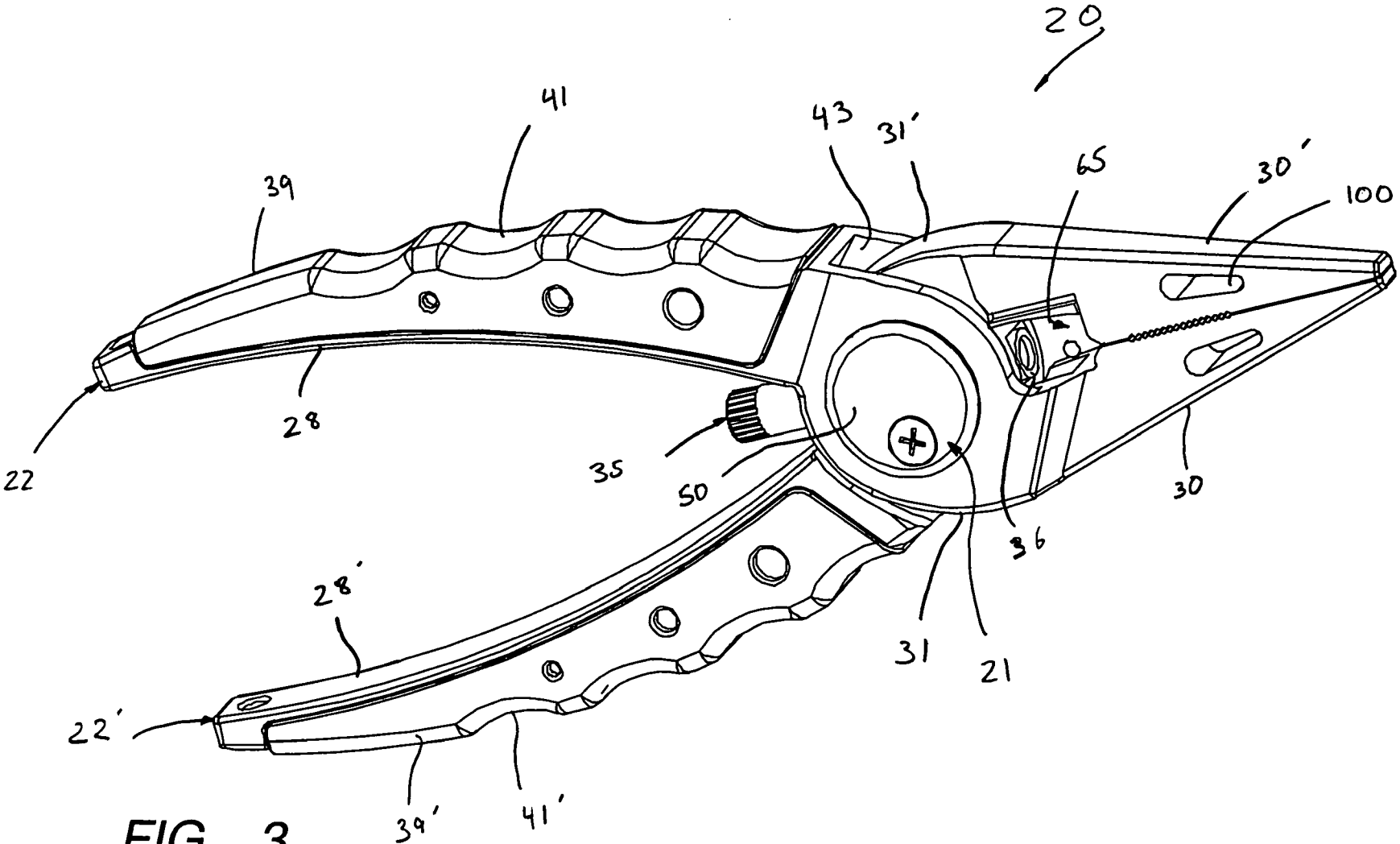
FIG. 3 is a side elevation view of the lighted hand tool apparatus of FIG. 1, illustrated in a closed condition.

Referring now to FIGS. 1-5, a lighted plier hand tool apparatus, generally designated 20, is provided having a pivoting hub device 21 and a pair of interconnecting plier members 22, 22'. The hub device 21 includes a first opening (25, 25'), an opposed second opening (26, 26'), and a passage (27, 27') (FIGS. 7 and 8) therethrough extending from the first opening to the second opening. The plier hand tool apparatus further includes a first plier member 22 and a second plier member 22'. Each plier member 22, 22' includes a respective handle portion 28, 28', a jaw portion 30, 30', and an intermediate pivot portion 31, 31' therebetween. Each respective pivot portion 31, 31' defines a respective bore section 32, 32' formed for co-aligned receipt of the hub device 21 therein. Such co-aligned receipt interconnects the first and second plier members 22, 22' together to enable relative pivotally movement of the respective jaw portions 30, 30' at a work area 33 between an opened condition (FIGS. 1, 3) and a closed condition (FIG. 3). The hand tool apparatus 20 further includes an illumination device 35 having an illumination portion 36 outputting a light beam from one end of an elongated body section 37. This body section 37 of the assembly 35 is formed and dimensioned for receipt in the passage (27, 27') of the hub device 21 such that the illumination portion 36 terminates proximate the work area for illumination thereof.

Accordingly, a lighted plier hand tool apparatus is provided that includes an illumination device extending directly through the pivoting hub device for direct illumination of the work area that is between the plier jaw portions without impeding the operation thereof. This is advantageous in that a high intensity light source can be applied that positions the illumination portion of the light assembly adjacent to the work area for direct illumination with little or no loss of light intensity through reflection or diffusion.

The illumination device 35, briefly, is provided by a small flashlight-style device having a cylindrical-shaped elongated body section 37 with an illumination portion 36 on or proximate the distal end thereof. The illumination portion 36 carries a light source that is employed to directly illuminate the work area 33 with its light beam. In one preferred embodiment, the light source includes a high intensity LED, which is suitable for close range high intensity illumination with the benefit of significantly reduced power consumption. In particular, a high intensity red LED may be employed. In another configuration, the lighting may be provided by other conventional lighting sources such as an incandescent or fluorescent source. A conventional on/off switch may be provided for manual operation of the light assembly, such as a rotational switch oriented at the proximal end of the elongated body.

Figure 6:
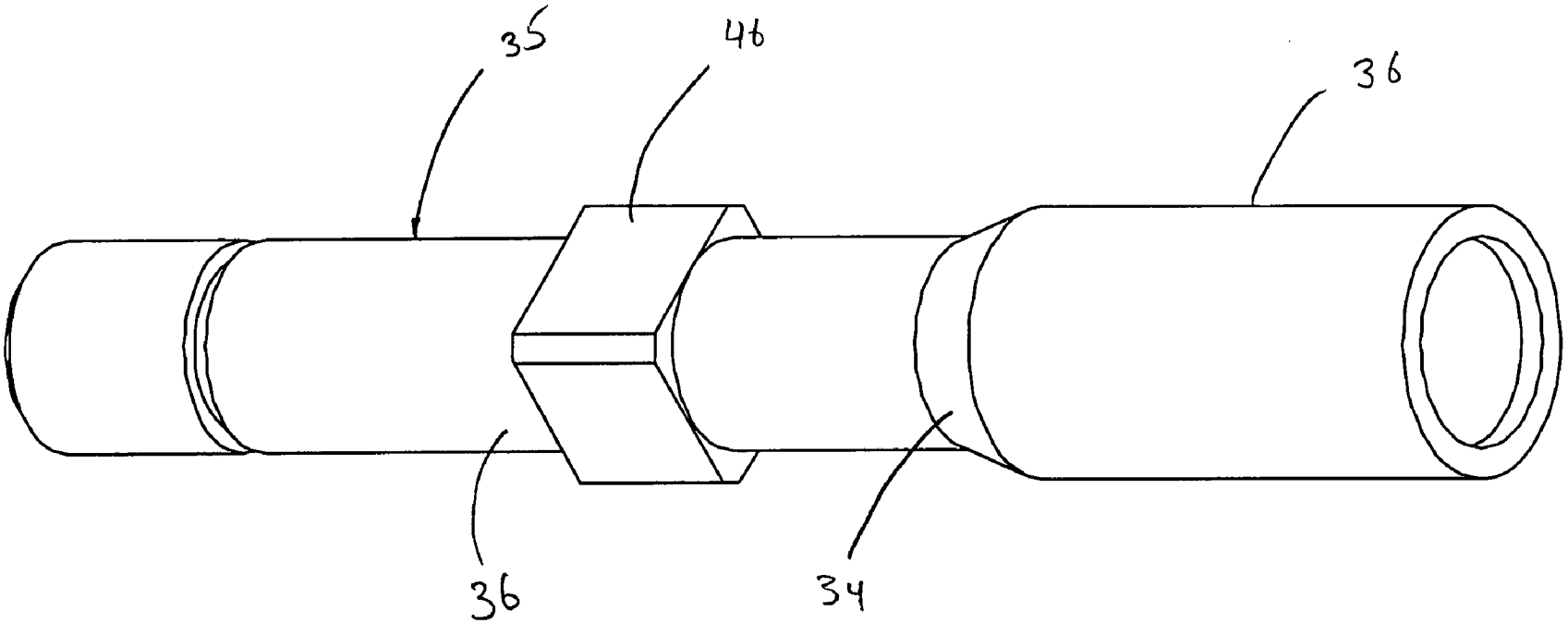
FIG. 6 is a top perspective view of an illumination device of the lighted hand tool apparatus of FIG. 1.

In one embodiment, as shown in FIGS. 2 and 6, the illumination portion 36 is also substantially cylindrical, but is of a diameter larger than that of the elongated body section 37. These two components intersect at an annular shoulder portion 34 that extends radially outward from the body section. As will be described, in this configuration, the illumination portion 36 is configured to extend past the distal portions of the pivot portions 31, 31', and in between the jaw portions 30, 30'.

Figure 4:
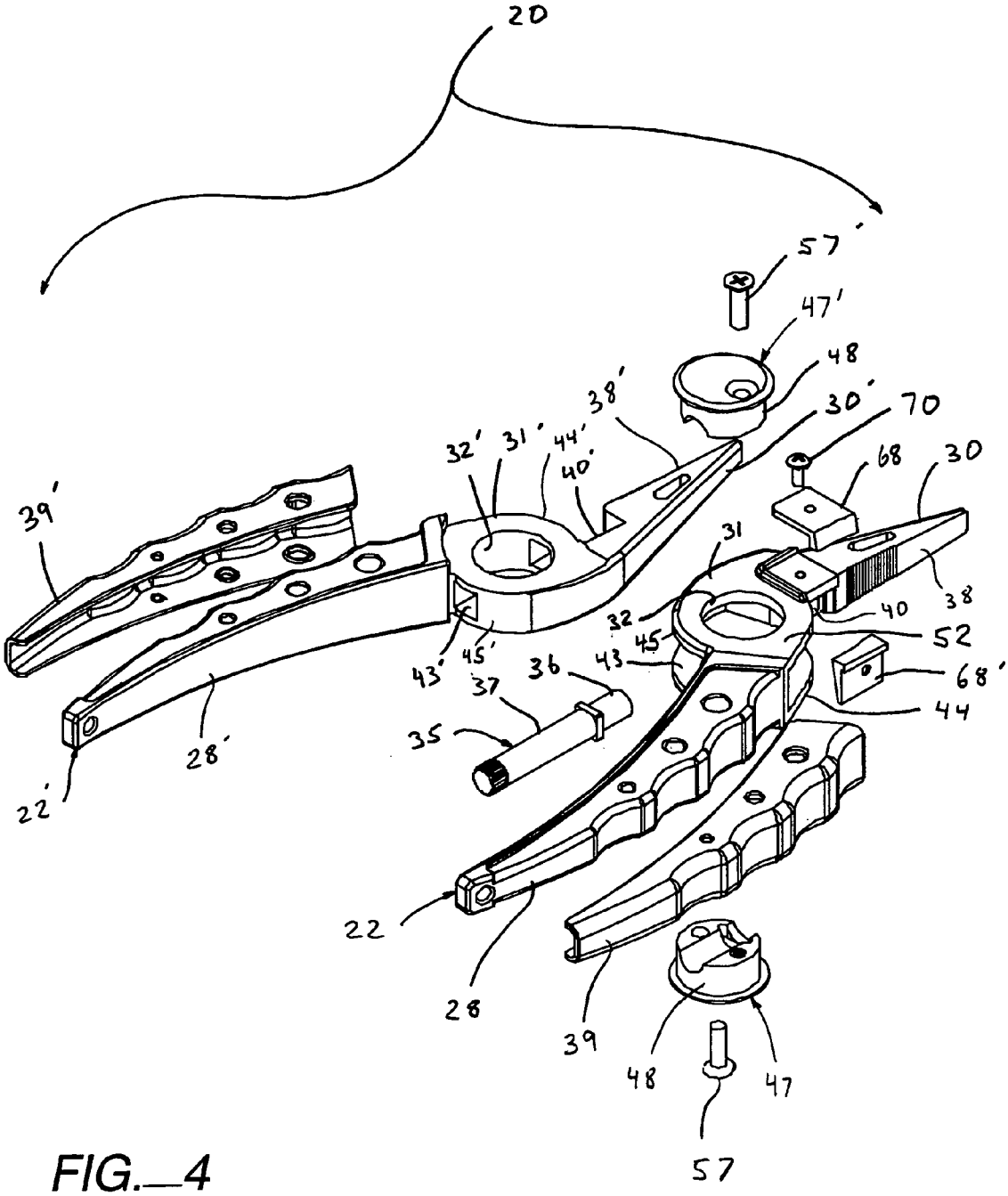
FIG. 4 is an exploded, top perspective of the lighted hand tool apparatus of FIG. 1.
Figure 7:
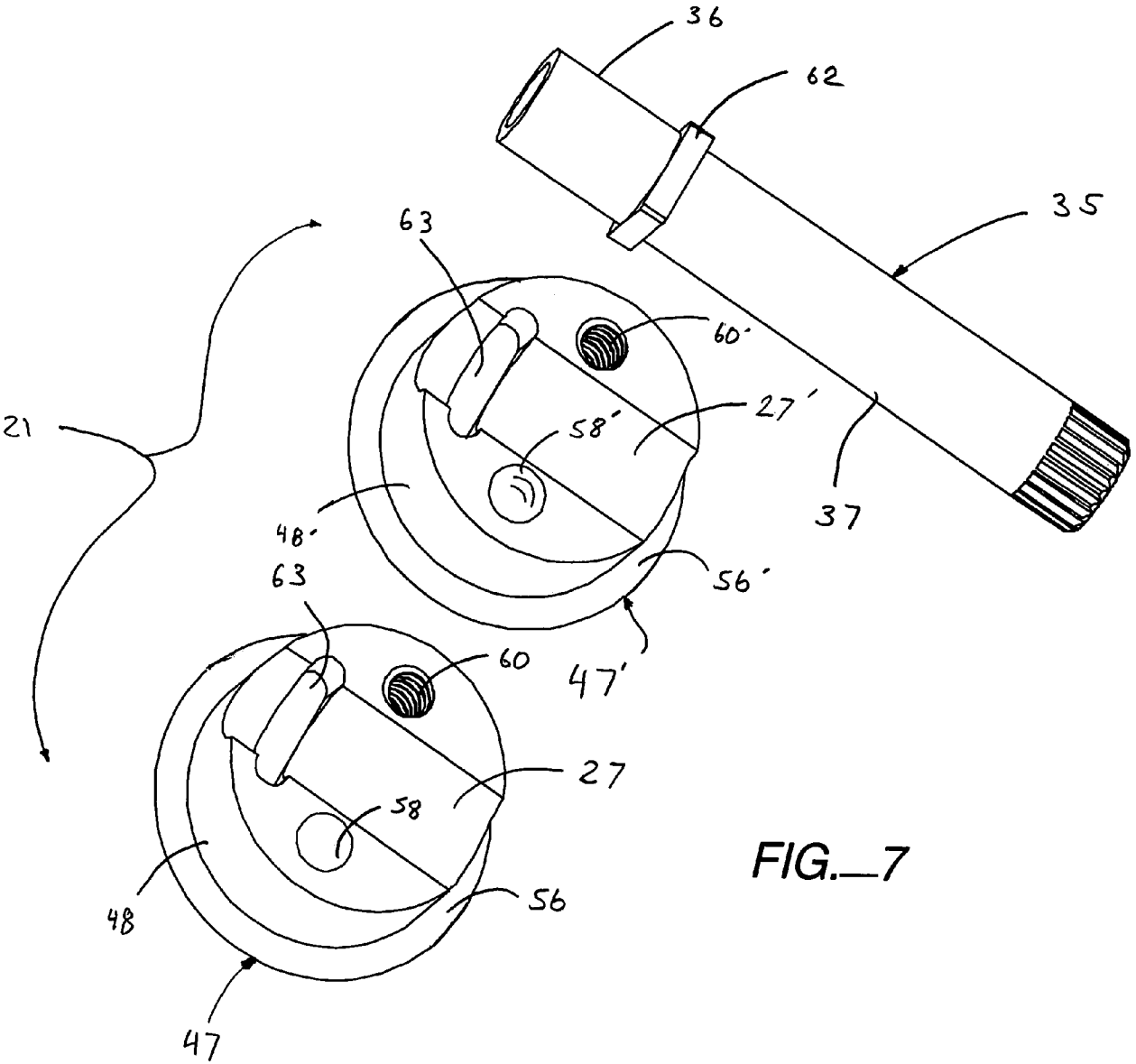
FIG. 7 is an enlarged, top perspective view of a hub device and alternative embodiment illumination device for the lighted hand tool apparatus of FIG. 1.
Figure 8:
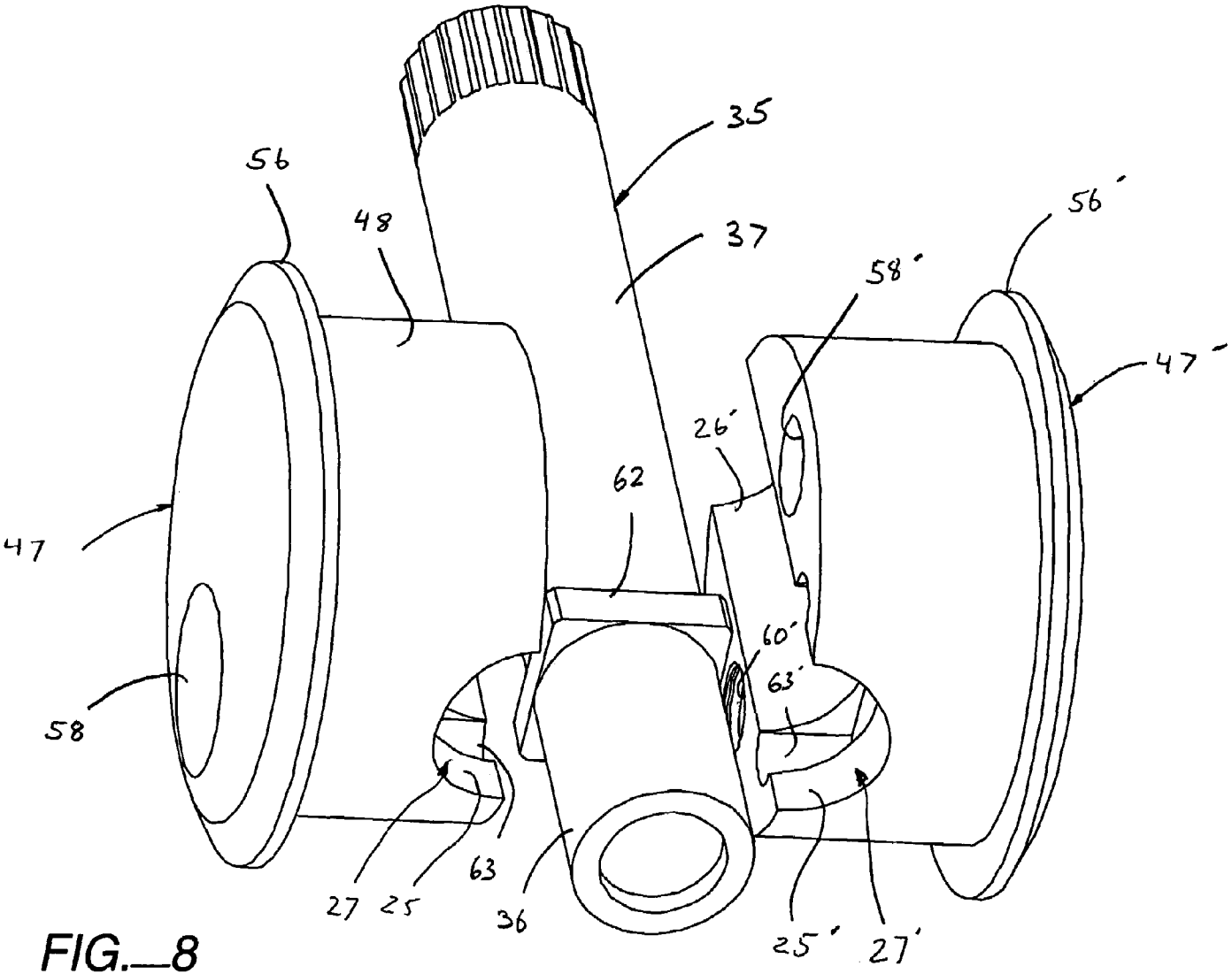
FIG. 8 is an exploded, top perspective view of the hub device and illumination device of FIG. 7.

In another embodiment, as shown in FIGS. 4, 7 and 8, the illumination portion 36 may have a diameter substantially equal to that of the elongated body section 37, if not indistinguishable therefrom. Hence, the illumination portion 36 is essentially integral with the elongated body section 37. As will be described, depending upon the configuration, the distal end of illumination portion 36 may be positioned relatively flush with the distal portions of the pivot portions 31, 31', or just protruding into the work area, as best illustrated in FIG. 3.

Figure 5:
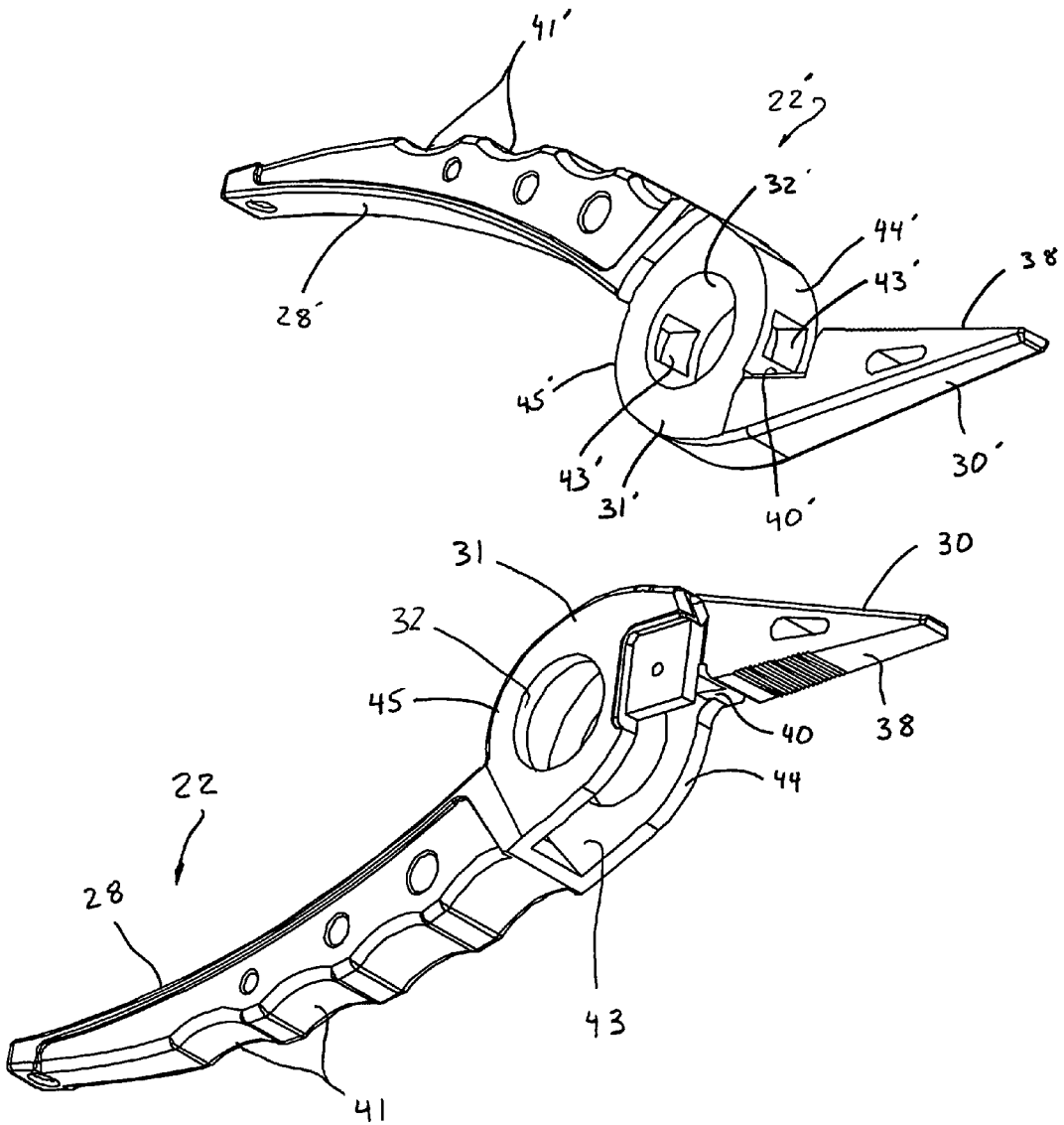
FIG. 5 is a top front perspective view of the first and second plier members of the lighted hand tool apparatus of FIG. 1.

As best viewed in FIGS. 4 and 5, the first plier member 22 and the second plier member 22' are shown to be generally mirror images of one another with exception to the respective pivot portions 31, 31'. Each of the first jaw portion 30 and the second jaw portion 30' includes an opposed work surface 38, 38' that collectively define the work area 33 when the plier members 22, 22' are operationally interconnected about the hub device 21. While shape and area of the work surfaces 38, 38' are shown as being relatively rectangular and substantially planar, these dimensions may be varied, and the work surfaces may be conventionally teethed, kneeled or ridged to promote frictional gripping.

In one specific embodiment, such as the embodiment having the illumination portion extending into the work area, at least one of the work surfaces 38, 38' of the respective jaw portions 30, 30' defines receiving cavity 40, 40' at a proximal end of the work area. This slot or cavity 40, 40' is formed and dimensioned for receipt of at least a portion of the illumination portion 36 of the illumination device 35 disposed at the proximal end of the work area 33. As best viewed in FIG. 3, when the jaw portions 30, 30' are oriented in the closed condition, the receiving cavity 40, 40' allows the opposed work surfaces 38, 38' of the corresponding jaw portions 30, 30' to be oriented relatively adjacent to (if not touching) one another to increase the useful surface area of the work area.

Further, the footprint of each jaw portion 30, 30' is shown in a "needle-nose" plier shape, where the jaw portions taper inwardly from the proximal end to the distal end thereof. This tapered shape is particularly useful for certain applications such as for fishing. Other conventional plier jaw shapes can be implemented as well, however, depending upon the desired application, without departing from the true spirit and nature of the present invention.

Similarly, the respective first handle portion 28 and the second handle portion 28' of the respective first plier member 22 and the second plier member 22' are essentially mirror images of one another. As shown, each handle portion 28, 28' is curved along a path generally opposite to one another when the plier members 22, 22' are operationally interconnected about the hub device 21. Such curvatures, however, can be altered for a desired application.

Each handle portion 28, 28' includes a plurality of adjacent finger depressions or grooves 41, 41', respectively, that extend laterally across the outer facing surfaces of the respective handle portions 28, 28'. These grooves 41, 41' aid gripping of the handle portions 28, 28' by the fingers and palms of the user's hand. It will be appreciated, however, that other conventional handle shapes designs for plier tools designs can be included. Further, a plastic or rubber sleeve or grip 39, 39', coating or the like (FIG. 4) may be provided over the grooves to promote gripping and comfort.

In accordance with the present invention, the intermediate pivot portions 31, 31' of each plier member 22, 22' cooperate with the hub device 21 to interconnect the plier members together for rotational movement of the respective jaw portions about the hub device. Similar to most "cross-jaw" plier tool designs, by squeezing the respective handle portions 28, 28' together, the gripping force of the opposed jaw portions 30, 30' can be controlled from the opened condition (FIGS. 1 and 2) toward the closed condition (FIG. 3). Further, as will be described in greater detail below, the hub device also functions as a mounting support and communication conduit for the illumination device that enables direct in-line communication of the light source to the work area.

Preferably, each plier member 22, 22' includes a respective bore section 32, 32' sized for sliding axial receipt of the hub device 21 therethrough. As best viewed in FIGS. 4 and 5, the bore sections 32, 32' are preferably cylindrical shaped, and extend laterally through the respective pivot portions 31, 31', from one side thereof to the opposite side. Each bore section 32, 32' is oriented, relative the jaw portions 30, 30', such the longitudinal axis 42 (of the jaw portions and the hub device when mounted) is substantially perpendicular to a vertical plane bisecting the two plier member 22, 22'.

FIGS. 4 and 5 further illustrate that each pivot portion 31, 31' includes a central passageway 43, 43' extending therethrough. Each passageway 43, 43' communicates with the corresponding bore sections 32, 32', but each extends generally in a direction that is substantially perpendicular to the corresponding bore sections 32, 32'. Generally, as illustrated, a distal portion 44, 44' of each pivot portion 31, 31' faces toward the respective work surface 38, 38' of the corresponding jaw portion 30, 30', while an opposed proximal portion 45, 45' faces away from the work area or toward the corresponding handle portion 28, 28' thereof. Collectively, these central passageways 43, 43' cooperate in a nested manner and are co-aligned with the communication passage 27 of the hub device 21, as will be described, to permit the passage of the elongated body section 37 of the illumination device 35 through the hub device 21, without impeding operation of the jaw portions 30, 30'

In accordance with one specific embodiment of the present invention, the central passageway 43 of the first plier member 22 is further sized for receipt of the pivot portion 31' of the second plier member 22' therein. As shown in FIG. 5, the width of the central passageway 43 of the first pivot portion 31 is slightly larger than the width of both the jaw portion 30' and the pivot portion 31' for sliding receipt therethrough. The tolerance between these opposed surfaces (i.e., the exterior walls of the second pivot portion 31 of the second plier member 22' and the interior walls defining the first central passageway 43 of the first plier member 22), however, should be sufficiently large to permit relative rotational movement about the co-axial bore section axes, yet bet sufficiently small to prevent excessive lateral displacement therein during operation.

During assembly, by way of example, the tip of the second jaw portion 30' is inserted through the first central passageway 43 in a manner positioning the corresponding work surfaces 38, 38' of the jaw portions 30, 30' in opposed relationship to one another. As the second jaw portion 30' extend through the distal portion 44' of the second central passageway 43' of the first plier member 22, the second pivot portion 31' of the second plier member 22' is inserted into the first central passageway 43, nesting the corresponding pivot portions 31, 31' until the corresponding bore sections 32 are substantially co-axial with one another. As will be described below, this hub device 21 is then applied to interconnect the nested pivot portions 31, 31'.

The second central passageway 43' of the second plier member 22', however, is significantly smaller in width and overall dimension than the first central passageway 43, but does generally extend in a direction substantially perpendicular to the longitudinal axis 42 of the hub device 21. The second passageway 43' is suitably sized to permit positioning of the elongated body of the illumination device therethrough such that the illumination portion is disposed between the operating jaw portions 30, 30' at a proximate to a proximal region of the work area. Hence, the illumination device, which is primarily mounted to the hub device 21, can be positioned through both the distal portion 44' and opposed proximal portion 45' of the second passageway 43'.

As best viewed in FIGS. 4 and 5, in one specific embodiment, the transverse cross-sectional dimension of the second central passageway 43' is shaped to conform with a mating collar portion 46 extending outward from the elongated body section 37 of the illumination device 35. During assembly, as will be described, the collar portion 46 is sized dimensioned to be slidably received in axially in the second central passageway 43'. The polygonal-shape of the collar portion 46, as well as the shape of the mating second central passageway 43' prevents rotation of the illumination device 35 about its longitudinal axis while secured in the pivot portion 31'. Moreover, this design configuration secures the elongated body section 37 of the illumination device 35 to the second plier member 22' so that the light beam of the illumination portion 36 is affixed relative to the second jaw portion 30' during movement of the hand tool apparatus 20 between the opened condition and the closed condition.

Figure 10:
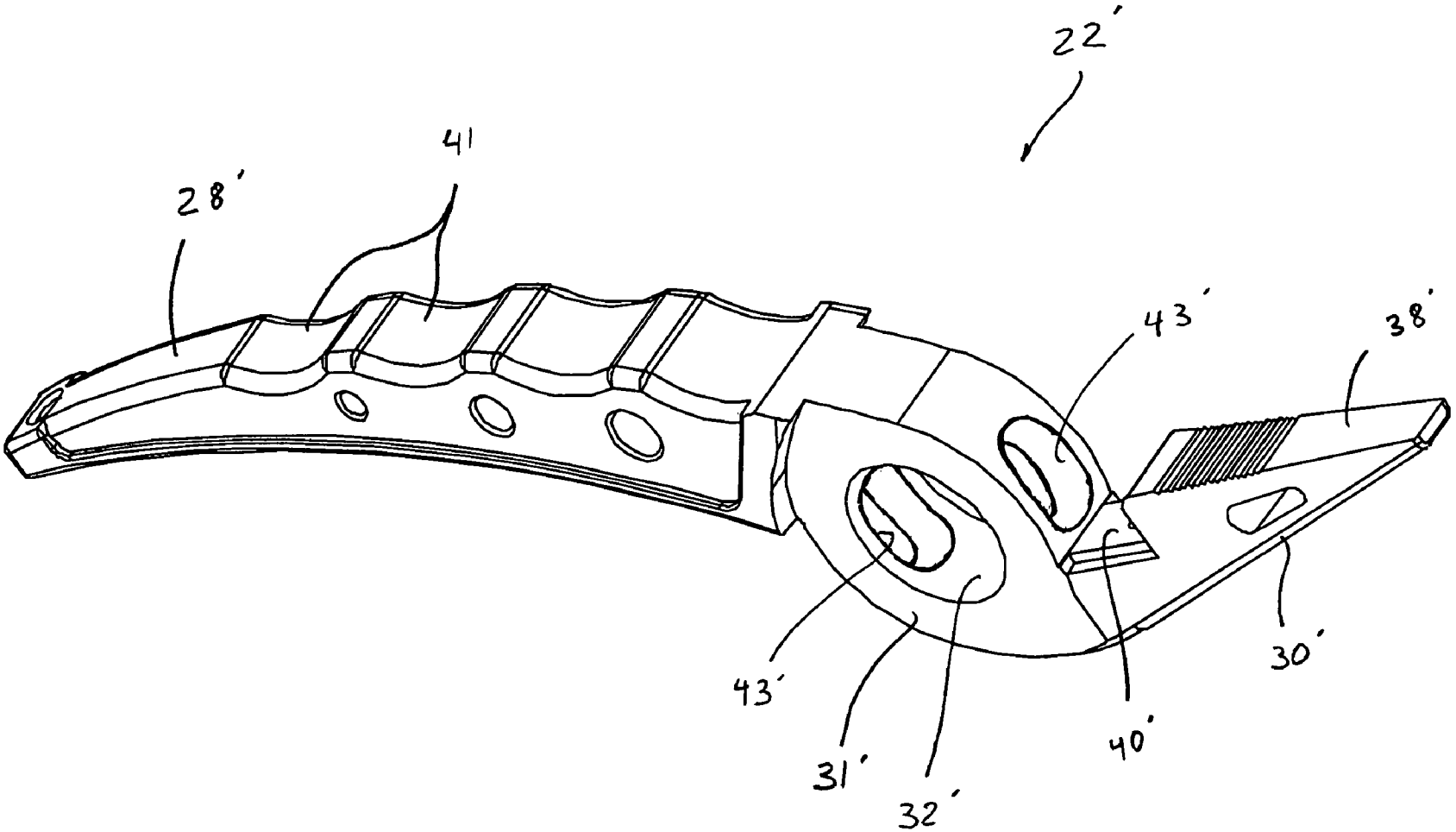
FIG. 10 is a top front perspective view of an alternative embodiment second plier member having an oblong central passageway.

In an alternative embodiment, as shown in the second plier member 22' of FIG. 10, the second central passageway 43' is oblong-shaped, having a height greater than its width. Hence, in this specific configuration, the angle or position of the illumination portion 36 of the illumination device 35 can be adjusted or positioned to a limited extent relative to the jaw portions 30, 30'. More preferably, the elongated body section 37 may be permitted limited displacement or rotation, together with the hub device 21, about the hub longitudinal axis 42. This permits the light beam to be manually adjusted to a limited extent relative the work area. In another example, such a configuration will permit the beam to be centered with the work area during operational movement of the jaw portions. In another specific embodiment, however, the angle or position of the illumination portion 36 will be fixed relative to one of the jaw portion, while being moveable relative to the other jaw portion.

Referring now to FIGS. 7 and 8, the hub device 21 is preferably provided by a first and second hub section 47, 47'. Each hub section includes a barrel portion 48, 48' defined by the outer cylindrical surfaces, and two circular end caps 50, 50' that may seat flush with the opposed side walls 51, 52 of the first pivot portion 31 of the first plier member 22. The outer cylindrical surfaces of the hub barrel portion 48, 48' have a transverse cross-sectional dimension sized for axial sliding receipt in the co-aligned bore sections 32, 32' of the pivot portions 31, 31'. By axially positioning the hub device 21 into the co-aligned bore sections 32, 32', the two pivot portions 31, 31' are retained in a nested, aligned relationship during operation thereof.

The tolerance between the outer cylindrical surfaces of the hub device 21 and the respective interior walls defining the bore sections 32, 32' should also be sufficiently large to permit relative rotational movement about the hub device, yet bet sufficiently small to prevent excessive radial displacement relative the hub device during operation.

As mentioned, the hub device 21 includes a communication passage 27 that is formed and dimensioned for retained receipt of the illumination device 35 therein. This communication passage 27 extends radially through the center of the barrel portions 48, 48' of the hub device 21, substantially perpendicular to the longitudinal axis 42 of the hub device 21. When the hub device is properly oriented and positioned in the bore sections 32, 32', interconnecting the plier members 22, 22', the communication passage 27 of the hub device 21 is aligned with the nested central passageways 43, 43' of the pivot portions 31, 31'. Hence the first opening (25, 25') of the passage (27, 27') is in open communication with the nested distal portions 44, 44' of the pivot portions, while the opposed second opening (26, 26') of the passage (27, 27') is in open communication with the nested opposed proximal portions 45, 45' of the pivot portion. In this configuration, the illumination device 35 can be simultaneously positioned through both the pivot portions 31, 31' and the hub device for support and placement.

In one specific embodiment, the hub device 21 is provided a first hub section 47 and a second hub section 47'. As shown in FIGS. 7 and 8, each hub section 47, 47' preferably defines a fractional portion 27, 27' of the hub passage such that when the hub sections 47, 47' are assembled, the hub passage for the elongated body section 37 of the illumination device is collectively defined. More preferably, each hub section 47, 47' is essentially identical and defines substantially one-half of the hub device 21 as if a plane substantially perpendicular to the longitudinal axis 42 bisected the hub device. Accordingly, with the collective passage positioned central to the hub device 21, each passage portion 27, 27' defines substantially one-half of passage.

Hence, during assembly of the plier tool apparatus 20 with the two-piece hub device 21, the barrel portions 48, 48' of the opposed hub sections 47, 47' may be slideably positioned into the co-aligned bore sections 32, 32' from opposed side walls 51, 52 of the first pivot portion 31. Insertion of hub section 47, 47' continues until the corresponding flange portions 56, 56' of the end caps 50, 50', respectively, extending radially outward from the corresponding outer cylindrical surface of the barrel portion 48, 48', contacts the corresponding from opposed sidewalls 51, 52 of the first pivot portion 31.

By fastening the hub sections together, the inwardly facing, opposed flange portions 56, 56' contact the outwardly facing side walls 51, 52 of the first pivot portion 31, retaining the pivot portions 31, 31' in a nested relation. In one specific embodiment, threaded fasteners 57, 57' are applied to opposed sides of the hub passage (27, 27'). Each hub section 47, 47' includes an aperture 58, 58' sized for receipt of the respective fastener 57, 57' that is aligned with a threaded port 60, 60' on the opposed interior surfaces of the opposed hub section when the two are aligned for interconnection. The corresponding threaded fastener 57, 57' or the like engages the respective threaded port 60, 60', removably mating the hub section 47, 47' together.

As above indicated, the opposed end caps 50, 50' of the corresponding hub sections 47, 47' include flange portions 56, 56' extending radially outward from the external facing cylindrical surfaces of each respective hub section 47, 47'. Accordingly, when the two sections are fastened together, via fasteners 57, 57', in the co-aligned bore sections 32, 32', the opposed flanges portions 45, 45' of the hub sections 47, 47' cooperate with the outer surfaces of the corresponding plier members 22, 22' to retain and interconnect the pliers in the nested condition of the cross-jaws. In one specific embodiment, the outwardly facing side walls 51, 52 of the first pivot portion 31 each includes an annular slot (not shown) surrounding the opening into the bore section 32. These annular slots are formed for receipt of the end cap flange portions 56, 56' therein in a manner positioning the surface of the end caps substantially flush with the side walls 51, 52 of the first pivot portion 31.

Moreover, this two-piece arrangement allows the elongated body section 37 of the illumination device 35 to be gripped in a clamshell-type manner between the hub sections 47, 47'. Generally, when the hub device is assembled, the outer surface of the elongated body section 37 of the illumination device 35 cooperates with the interior surface of the walls defining the passage portions 27, 27' to grip and retain the illumination device to the hub device. In one specific embodiment, however, one of the outer surface of the elongated body section 37 and the interior surface of the walls defining the passage portions 27, 27' defines a retaining collar 62, while the other thereof defines a corresponding receiving slot 63. In the specific configuration shown in FIGS. 6-8, the elongated body section 37 provides the retaining collar 62 that extends radially outward, while the interior walls defining the passage portions 27, 27' define a corresponding receiving slot formed for receipt of the collar therein. It will be appreciated, however, that these retaining components may be reversed (i.e., the hub sections providing the collars, etc.) as well without departing from the true spirit and nature of the present invention.

During assembly of the hub sections 47, 47', when the elongated body 37 is positioned between the hub passage portions 27, 27', the retaining collar 62 is received in the corresponding receiving slot, preventing longitudinal displacement within the hub passage (27, 27'). In one configuration, the retaining collar 62 and corresponding receiving slot 63 is squared or non-annular. In this manner, both axial and rotational displacement of the illumination device 35 relative to the hub device 21 can be substantially prevented. It will be appreciated, however, that the retaining collar and corresponding receiving slot may be annular-shaped, as well.

In the mounting configuration of FIGS. 7 and 8, the distal end of the illumination portion 36 of the illumination device 35 can be positioned substantially flush with the distal portions 44, 44' of each pivot portion 31, 31'. As best illustrated in FIG. 3, this flush arrangement positions the illumination portion 36 out of the receiving cavity 40, 40', and hence, into work area 33. This reduces potential contact with any work items; reduces interference with the operation of the cutting section 65; as well as provides a sleeker overall appearance.

As above-mentioned, in one specific embodiment, the diameter of the illumination portion 36 of the illumination device is greater than that of the elongated body section 37, as well as being greater than the width of the central passageway 43' of the second plier member 22'. The shoulder portion 34, thus, prevents the axial passage of illumination portion 36 through the central passageway 43'. As a consequence of this design, the illumination portion protrudes from the pivot portions 31, 31' and extends partially into the work area 33 between the jaw portions 30, 30' (FIGS. 1 and 2). By way of example, before the hub fasteners 57, 57' are fully tightened, the proximal end of the elongated body section 37 may be slid axially through the co-aligned distal portions 44, 44' of the passageways 43, 43' and into the communication passage 27 of the hub device 21 from the jaw portions 30, 30', in the opened condition. The proximal end of the elongated body passes out the second opening 26 of the hub communication passage 27 and through the opposed proximal portion 45 of the nested pivot portions. This continues until the shoulder portion 34 of the illumination device 35 is preferably oriented adjacent to, or contacts, the end of the pivot portion 31' defining the passageway 43' of the second pivot portion 31' (FIG. 6). The fasteners can then be tightened, which friction fit clamp the hub sections 47, 47' about the elongated body section 37 of the illumination device.

Figure 9:
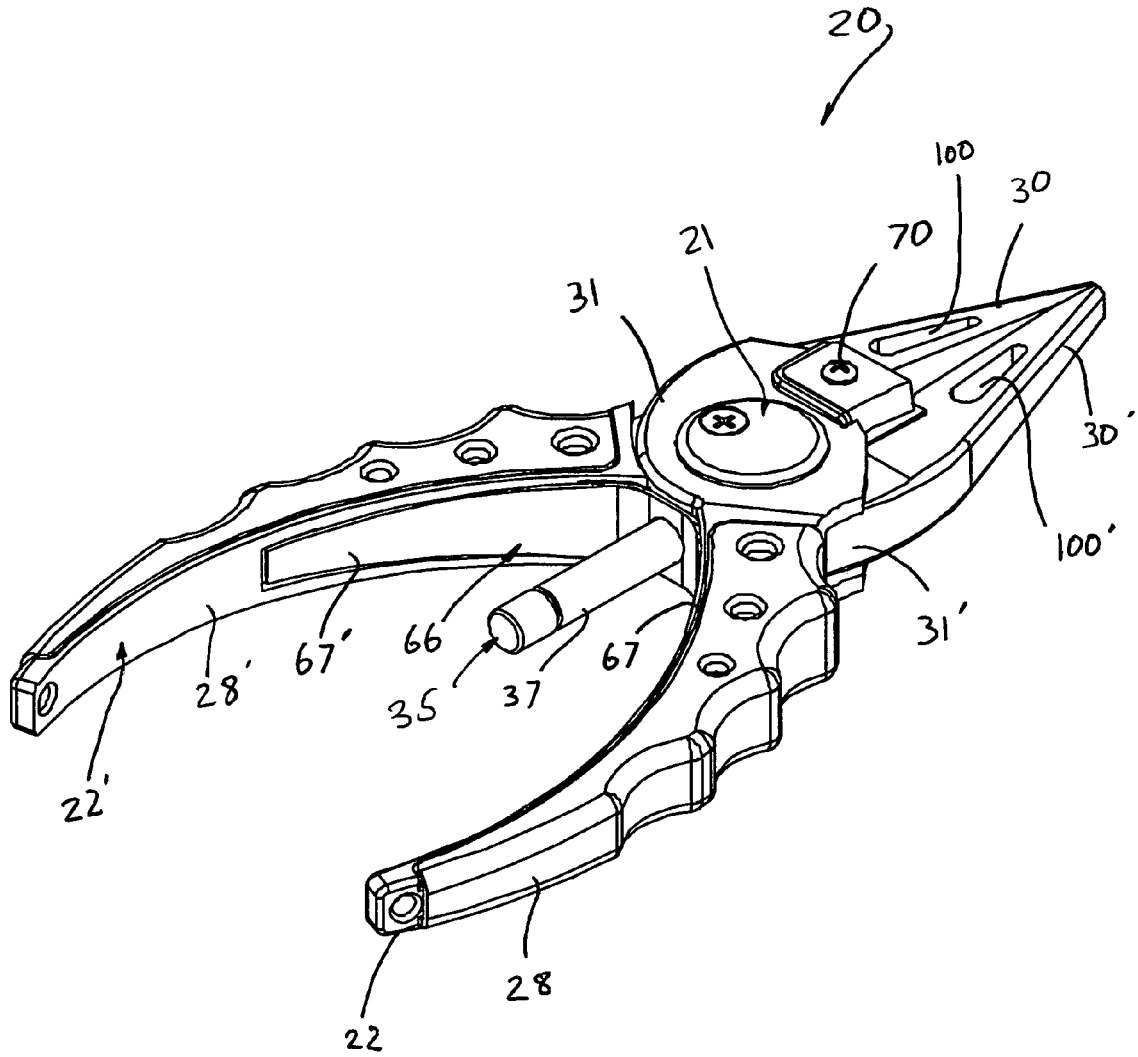
FIG. 9 is a top rear perspective view of an alternative embodiment lighted hand tool apparatus, incorporating a retaining clip and opposed spring arms.

In another specific embodiment, as shown in FIG. 9, the illumination device may be mounted to the plier hand tool apparatus 20 through a retaining clip 66 having an aperture press-fit over the proximal end of the elongated body section 37. As the shoulder portion 34 of the illumination portion 36 is positioned against the distal surfaces of the pivot portions 31, 31', the resilient retaining clip 66 is slid in a distal direction along the elongated body. Once the retaining clip 66 contacts one or both proximal surfaces of the pivot portions 31, 31' of the plier members 22, 22', the illumination device 35 is retained thereagainst.

In yet another specific embodiment, retaining clip 66 includes a pair of opposed spring arms 67, 67' extending in opposite directions substantially adjacent an underside of the handle portions 28, 28'. These spring arms 67, 67' function as a spring device that biases the handle portions, and hence the jaw portions, toward the opened condition upon contact therewith.

The cutting section 65, positioned adjacent or proximate to the receiving cavity 40, 40', includes a pair of replaceable blade components 68, 68' that are mounted to the respective jaw portions 30, 30' through fasteners 70 (FIGS. 1 and 4). Each blade component 68, 68' includes a respective cutting edge operated by the handles and cooperating with one another to cut a work piece when the jaw portions are moved to the closed condition. These replaceable blades preferably include a tungsten carbide cutting edge that is extremely durable and capable of maintaining a sharper edge for longer periods before replacement is necessitated.

Referring now to FIGS. 11-16, another specific embodiment is shown incorporating an illumination device 35 that is substantially fully enclosed within the hub device 21 itself, except for the illumination portion 36 that is positioned to illuminate the work area 33. In this configuration, a significantly more compact illumination unit is applied that is incorporated and integrated into the hub sections 47, 47' itself. Accordingly, the overall profile or footprint of the hub device/illumination device combination is significantly reduced, eliminating any extension of the illumination device 35 past the pivot portions 31, 31' of the plier members 22, 22' (FIG. 12). Moreover, the respective central passageway 43' of the second plier member 22' can only be accessed from the front of the respective pivot portion 31' (facing the work area and respective jaw portion 30'), eliminating any rear entrance and associated potential area of a moisture leakage.

In this specific configuration, the illumination device 35 is preferably includes by a high output white LED light 79 having a substantially cylindrical body portion and a domed illumination portion 36.

Figure 16:
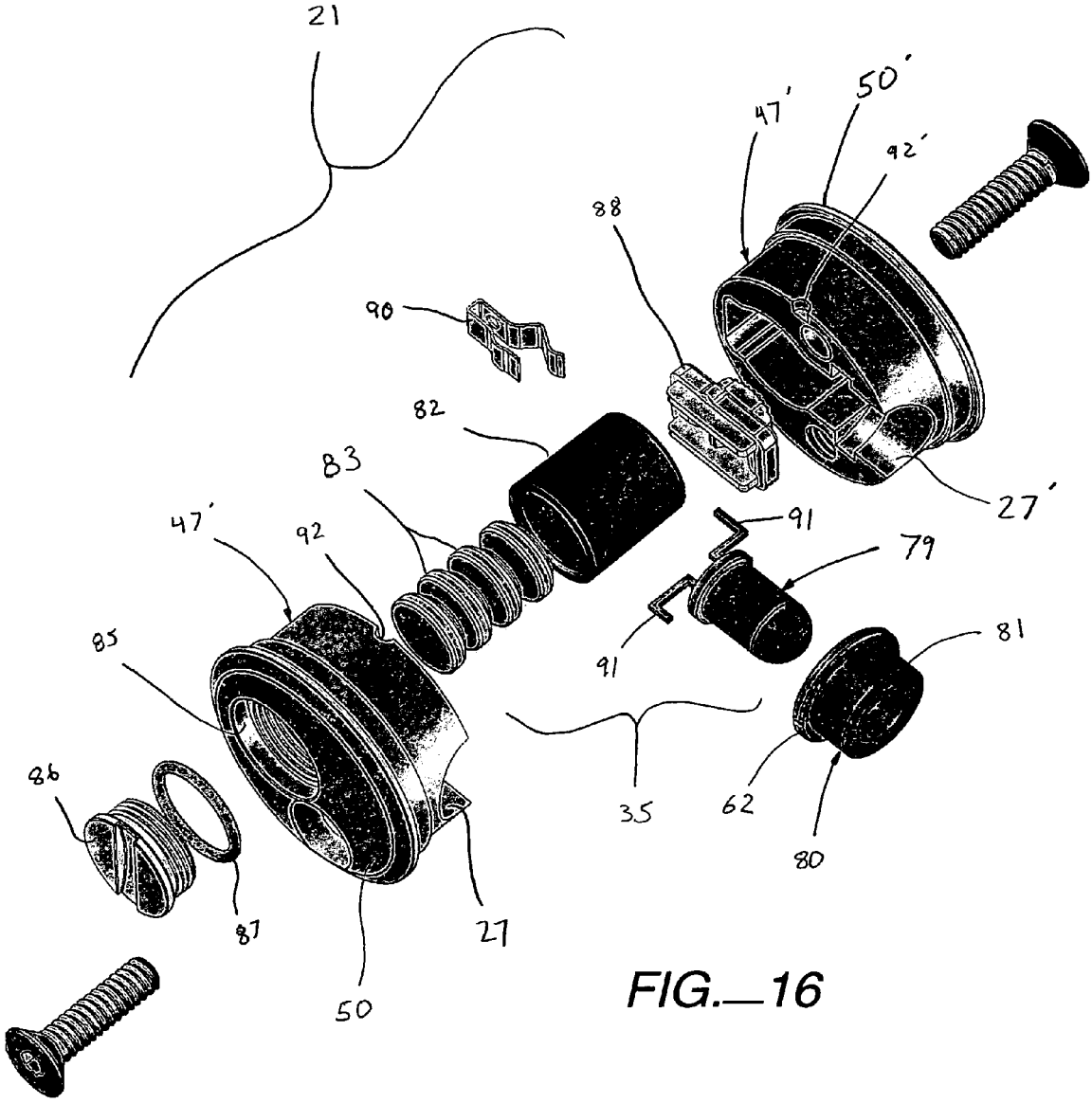
FIG. 16 is an exploded, top perspective view of the integrated hub/illumination device for the lighted hand tool apparatus of FIG. 1.

The cylindrical-shaped LED body portion is slip-fit secured in an annular sleeve device 80 that provides a watertight sealed barrier between the LED light 79 and communication passage 27, 27' of the hub device 21 (FIG. 16). The sleeve device 80, preferably composed of a pliable watertight material such as rubber or silicon material, includes a barrel portion 81 sized and dimensioned for receipt in the hub device passage (collectively defined by passage portions 27, 27') of the hub device 21. A collar portion 62 protruded radially outward that is received in the corresponding receiving slots 63, 63' of the respective hub sections 47, 47'. In this particular configuration, the LED domed illumination portion 36 itself protrudes past the sleeve barrel portion 81 and the hub device passage portions 27, 27', and into the corresponding central passageway 43' of the second plier member. Preferably, however, the LED domed illumination portion 36 remains fully recess in, and does not extend beyond the respective central passageway. Such a recessed arrangement will reduce any operational interference that might otherwise be experienced during use.

Figure 17:
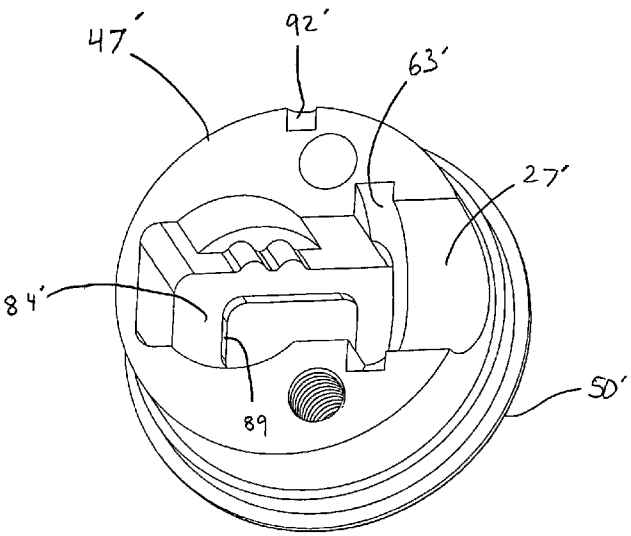
FIG. 17 is an enlarged, top perspective view of one hub device section for the lighted hand tool apparatus of FIG. 1.
Figure 18:
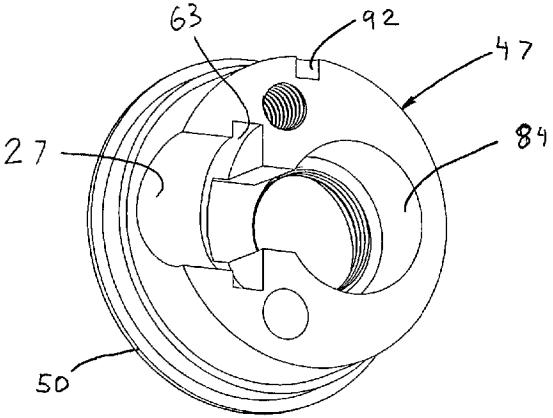
FIG. 18 is an enlarged, top perspective view of the other hub device section for the lighted hand tool apparatus of FIG. 1.

As mentioned above, the components of the illumination device 35 are essentially integrated into the hub sections 47, 47' itself, as compared to the above-mentioned embodiments. For example, as shown in FIG. 16-18, the illumination device 35 includes a cylindrical-shaped battery box 82 mounted in an interior cavity portion 84 of one of the hub sections (e.g., section 47) for the storage of one or more batteries 83. The battery box is mounted to the hub section 47 from an interior side, and is operationally accessible from a battery access port 85 through a corresponding end cap 50. Conventional small camera-style batteries may be inserted through the port 85, and into the battery box well to power the illumination device. A battery cover plate 86 is threadably mounted to the corresponding end cap 50 to cover the access port 85 and provide simplified access. A seal ring 87 is provided to prevent moisture leakage into the battery compartment.

An opposite end of the battery box 82 includes terminals (not shown) that are electrically coupled to a slider switch 88, via a conductive battery contact plate 90. The switch 88 extends through an elongated rectangular-shaped slot 89 form in the opposite end cap 50' of the corresponding opposite hub section 47' (FIG. 17). This switch 88 is formed for sliding movement in the elongated slot 89, and is operationally accessible from outside of the end cap 50' when the hub device is assembled with the illumination device 35. In turn, the contacts 91 of the LED light 79 are in communication with the contacts of the battery box 82 for selective powering thereof, via switch 88.

To prevent relative axial rotation about the hub axis 42, between the hub device 21 and the second plier member 22', during operable use, a key or pin device (not shown) is preferably disposed therebetween. For example, each hub section 47, 47' of the hub device 21 may include a pin slot section 92, 92' that collectively forms a pin hole sized and dimensioned for receipt of the pin or key device therein. Similarly, the pivot portion 31' of the second plier member 22' may define a corresponding elongated slot 93 (FIG. 14) in the interior wall 95' of the bore section 32'. This elongated slot 93 extends longitudinally along the bore section, and is sized and dimensioned for sliding receipt of a portion of the pin device that protrudes from the pin hole (92, 92') of the hub device 21.

Hence, upon sliding receipt of the pin device in the elongated slot 93, together with the assembly of the hub device 47, 47' from opposed sides of the bore section 32' of the plier members 22, 22', the pin device will span across from the hub device pin-hole (92, 92') and into the elongated slot 93. Such a bridge will effectively rotationally affix the hub device 21 to the corresponding pivot portion 31', about axis 42.

Figure 11:
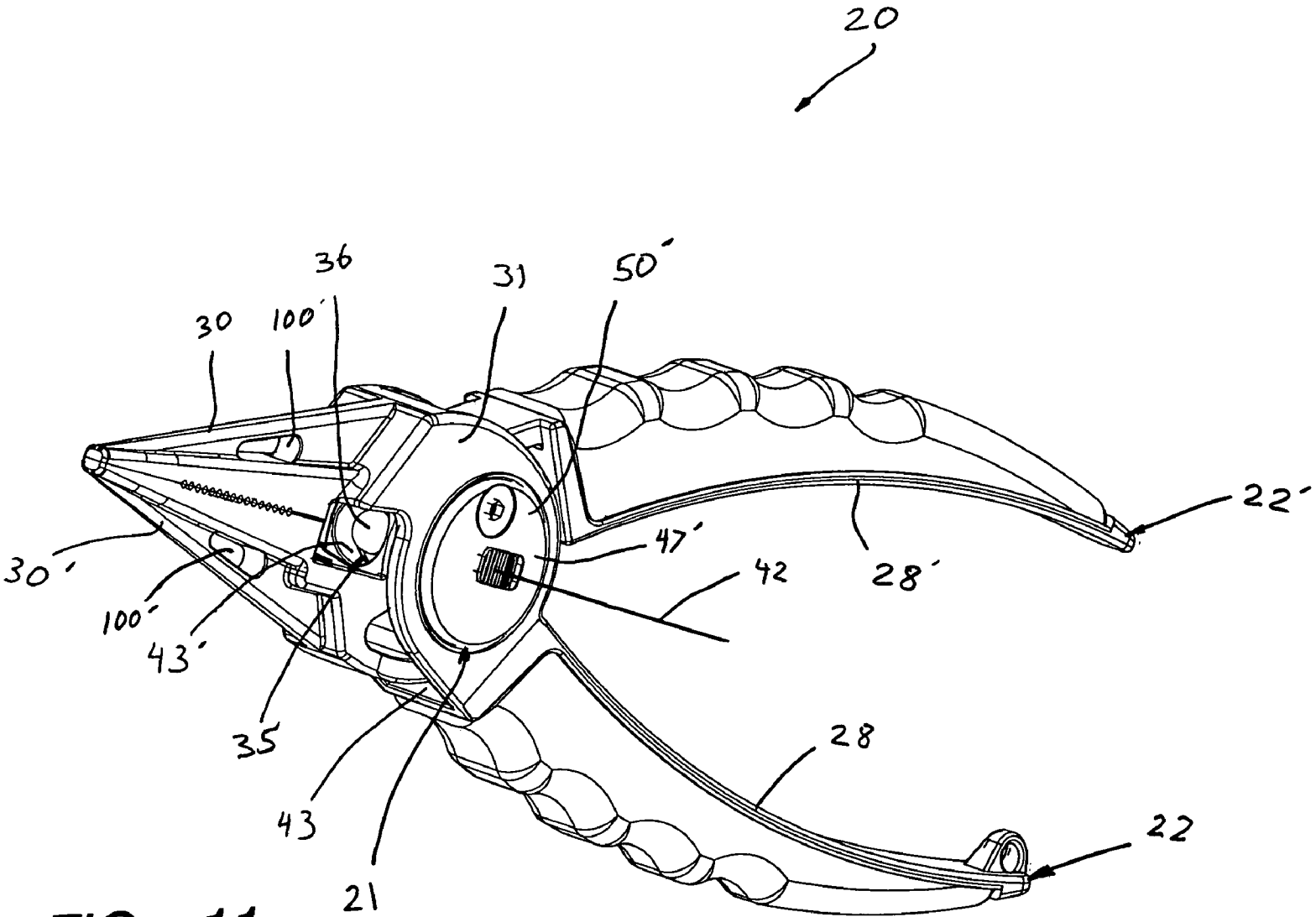
FIG. 11 is a top perspective view of another specific embodiment of the lighted hand tool apparatus designed in accordance with the present invention, in the closed condition.
Figure 14:
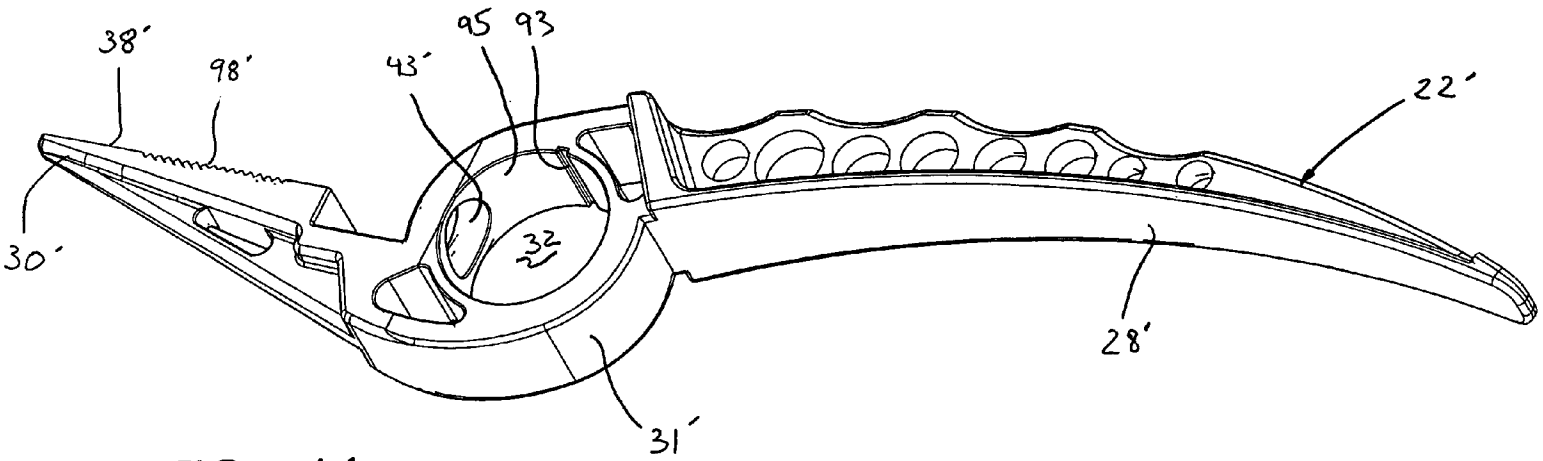
FIG. 14 is a bottom perspective view of the lighted hand tool apparatus of FIG. 11.
Figure 13:
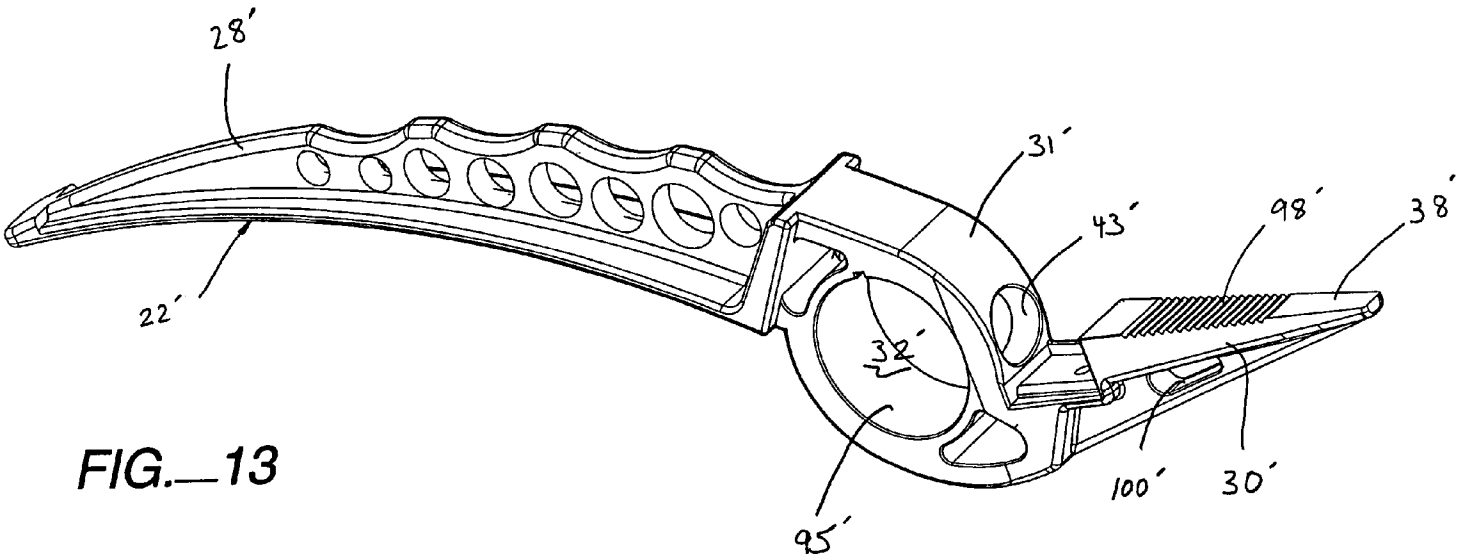
FIG. 13 is a top perspective view of the second plier member of the lighted hand tool apparatus of FIG. 11.
Figure 15:
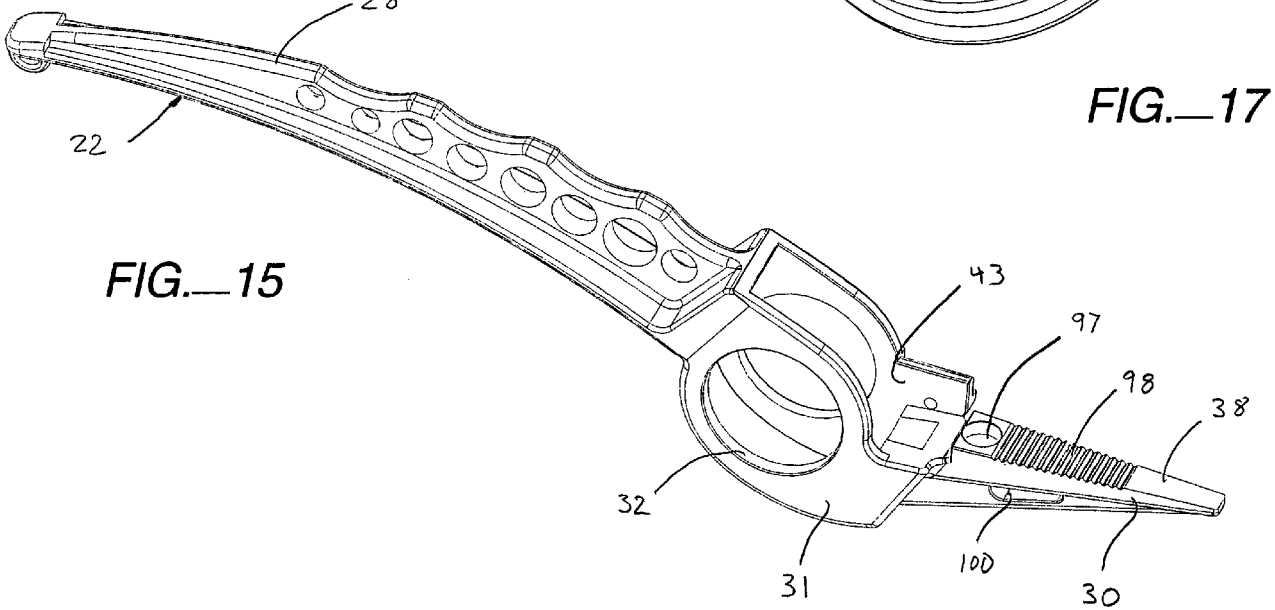
FIG. 15 is a top perspective view of the first plier member of the lighted hand tool apparatus of FIG. 11.

In accordance with another aspect of the present invention, the opposed jaw portions 30, 30' of the plier members 22, 22' are be magnetically retained in the closed condition (FIG. 11). More preferably, a magnet 96 or the like is be embedded in one or both of the opposed work surface of the corresponding jaw portion of the first plier member 22, for example (FIGS. 12 and 15). Upon near closure of the opposed jaws portions 30, 30', in the closed condition, the magnet(s) 96 draw and retain the jaws toward the closed condition. In order to open the jaw portions toward the opened condition, thus, such the magnetic force will have to be overcome, via the handle portions 28, 28'.

More particularly, the working surface 38 of the corresponding jaw portion 30 includes a recess 97 (FIG. 15), formed and dimensioned for friction fit receipt of the magnet 96 therein. The magnet recess 97 is sized and oriented to position a substantially planar surface of the magnet substantially flush with the substantially planar working surface 38. Preferably, this magnet is positioned rearward of the gripping ridge portion 98 of the working surface 38, as opposed to placement at the front portion thereof. While the magnet 96 may be placed any location longitudinally along the working surface, the front portion of the working surface 38 is typically subjected to a greater portion of the work. Hence, a location of the magnet rearward of the ridge portion 98 may be more suitable.

A second magnet (not shown) may be applied to the opposed jaw portion that is disposed opposite the first magnet 96, in the closed condition. Depending upon the strength of the magnets applied and/or the desired closure force, dual magnets may used. In other configurations, such as that shown, only one magnet 96 is necessary. In this configuration, at least the opposed jaw portion must be comprised of a material suitable for magnetic attraction. One such suitable material for the plier members 22, 22', including all the above embodiments, is stainless steel. For this particular embodiment, a magnetic stainless steel is preferred.

Finally, while all the embodiments above depict needle-nose style pliers typically applied for fishing and the like, it will be appreciated that the present invention may be applied for any style pliers, and/or vise grips.

Although only a few embodiments of the present inventions have been described in detail, it should be understood that the present inventions might be embodied in many other specific forms without departing from the spirit or scope of the inventions. For example, oval shaped openings 100, 100' may be provided in the outboard portions of the jaw portions 30, 30' that function to hold fishing hooks or the like while tightening a line to them.

What is claimed is:

1. A lighted plier hand tool apparatus comprising:

a hub device containing a first opening into an interior cavity therof;

a first plier member and a second plier member, each plier member having a respective handle portion, a jaw portion, and an intermediate pivot portion therebetween, each respective pivot portion defining a respective bore section formed for aligned receipt of the hub device therein, interconnecting the first and second plier members together for relative pivotally movement of the respective jaw portions that collectively define a work area between an opened condition and a closed condition, and at least one pivot portion defining a respective central passageway extending into the respective bore section and having an end port terminating at the work area to permit communication of the hub device first opening with the work area during operative use; and an illumination device having an illumination output portion outputting a light beam therefrom, said illumination device being formed and dimensioned for receipt in the interior cavity of the hub device in a manner aligning the output portion with the hub first opening to illuminate said work area during operative use.

2. The plier hand tool apparatus according to claim 1, wherein said respective bore sections of said first and second plier members extend substantially laterally across the corresponding pivot portions, and substantially perpendicular to the communication passage.

3. The plier hand tool apparatus according to claim 1, wherein said illumination device includes an elongated shaft portion supporting the output portion on a distal end thereof, said elongated shaft extending through the hub first opening and the respective pivot portion central passageway.

4. The plier hand tool apparatus according to claim 3, wherein at least one of said jaw portions includes a receiving cavity formed and dimensioned for receipt of the output portion of the illumination portion therein when the respective jaw portions are in the closed condition.

5. The plier hand tool apparatus according to claim 1, wherein each pivot portion of the first plier member and said second plier member includes a respective central passageway extending therethrough for nested receipt of the illumination device output portion, each central passageway having an end port terminating at the work area of the respective jaw.

6. The plier hand tool apparatus according to claim 5, wherein the respective central passageway of the second plier member extends longitudinally through the respective pivot portion, said respective central passageway of the second plier member further formed and dimensioned for sliding nested receipt in the respective central passageway of the first plier member therein for co-axial alignment of the respective bore sections of the first and second plier members.

7. The plier hand tool apparatus according to claim 6, wherein the respective central passageway is generally oriented along a longitudinal axis that is substantially perpendicular a longitudinal axis of the respective bore sections.

8. The plier hand tool apparatus according to claim 6, wherein said illumination device includes an elongated shaft portion supporting the output portion on a distal end thereof, said elongated shaft extending through the hub first opening and into the respective pivot portion central passageway of the second plier member.

9. The plier hand tool apparatus according to claim 8, wherein said central passageway of the second plier member is formed and dimensioned for snug sliding receipt of the illumination device elongated shaft therein.

10. The plier hand tool apparatus according to claim 8, wherein the respective central passageway of the pivot portion of the second plier member includes an oblong transverse cross-section dimension to permit directional adjustment of the light beam from illumination portion relative the work area.

11. The plier hand tool apparatus according to claim 10, wherein said directional adjustment is rotational about a longitudinal axis of the hub device.

12. The plier hand tool apparatus according to claim 1, wherein said hub device includes a first hub section and a second hub section, each the first hub section and second hub section cooperate such that when said first hub section is mounted to said second hub section, in the respective aligned bore sections of the first and second plier members, the hub device interior cavity is collectively defined and said pivot portion of the first plier member is pivotally coupled to the respective pivot portion of said second plier member for relatively pivotal movement of the jaw portions between the opened condition and the closed condition.

13. The plier hand tool apparatus according to claim 1, wherein the output portion of the illumination device is recessed within the central passageway of the corresponding the respective pivot portion of the plier members.

14. The plier hand tool apparatus according to claim 12, wherein said illumination device includes a high intensity while LED light source.

15. The plier hand tool apparatus according to claim 14, wherein said illumination device includes a battery box having a battery compartment enclosed within the interior cavity of the of hub device, said first hub section including an end cap that defines an access port for access to battery compartment of the battery box.

16. The plier hand tool apparatus according to claim 15, wherein said second hub section includes an end cap supporting a switch device operably coupling the battery box to the LED light source for operation thereof.

17. The plier hand tool apparatus according to claim 1, further including:

a magnetic coupling device cooperating with the respective jaw portions of the first and second plier members to magnetically retain the same together, in the closed condition.

18. The plier hand tool apparatus according to claim 17, wherein said magnetic coupling device includes a first magnet embedded in a work surface of a jaw portion of one of the first and second plier members, said magnet being positioned and configured to cooperate with an opposite work surface of the respective jaw portion of the other of the second and first plier member, in the closed condition, for the magnetic retainment therewith, in the closed condition.

19. The plier hand tool apparatus according to claim 18, wherein said magnetic coupling device includes a second magnet embedded in the opposite work surface of the other of the second and first plier member, said second magnet being positioned substantially opposite the first magnet, in the closed condition.

20. The plier hand tool apparatus according to claim 1, wherein one of the illumination device and an interior wall defining the hub device interior cavity includes a retaining collar, while the other of the interior wall and the illumination device defines a corresponding receiving slot.

21. The plier hand tool apparatus according to claim 20, wherein the periphery of the retaining collar and the corresponding receiving slot are non-circular.

22. The plier hand tool apparatus according to claim 21, wherein said periphery of the retaining collar and corresponding receiving slot are square- shaped.

23. A hand operated plier apparatus comprising:

a first plier member and a second plier member, each plier member having a respective handle portion, a jaw portion, and an intermediate pivot portion therebetween, each respective pivot portion interconnecting the first and second plier members together for relative pivotally movement of the respective jaw portions between an opened condition and a closed condition, and a magnetic coupling device cooperating with the respective jaw portions of the first and second plier member to magnetically retain the same together, in the closed condition.

24. The plier apparatus according to claim 23, wherein said magnetic coupling device includes a first magnet embedded in a work surface of a jaw portion of one of the first and second plier members, said first magnet being positioned and configured to cooperate with an opposite work surface of the respective jaw portion of the other of the second and first plier member, in the closed condition, for the magnetic retainment therewith.

25. The plier apparatus according to claim 24, wherein said magnetic coupling device further includes a second magnet embedded in a work surface of the jaw portion of one of the other of the second and first plier members, said second magnet being positioned opposite said first magnet, when the plier members are in the closed condition, for the magnetic retainment therewith.

26. The plier hand tool apparatus according to claim 1, wherein said illumination device includes a high intensity while LED light source.

27. A lighted hand operated plier apparatus comprising:

a first plier member and a second plier member, each plier member having a respective handle portion, a jaw portion, and an intermediate pivot portion therebetween, each respective pivot portion interconnecting the first and second plier members together for relative pivotally movement of the respective jaw portions that collectively define a work area between an opened condition and a closed condition, said intermediate pivot portions cooperating to define a central passage extending into the work area; and an illumination device having an illumination output portion outputting a direct light beam therefrom, said illumination device being formed and dimensioned for receipt in the central passage in a manner aligning the output portion to directly illuminate said work area during operative use.

28. The plier apparatus according to claim 27, wherein said illumination device includes an elongated shaft portion supporting the output portion on a distal end thereof, said elongated shaft extending through the respective pivot portion central passageway.

29. The plier apparatus according to claim 28, wherein at least one of said jaw portions includes a receiving cavity formed and dimensioned for receipt of the output portion of the illumination portion therein when the respective jaw portions are in the closed condition.

30. The plier apparatus according to claim 28, wherein said central passageway of the second plier member is formed and dimensioned for snug sliding receipt of the illumination device elongated shaft therein.

31. The plier apparatus according to claim 27, wherein the output portion of the illumination device is recessed within the central passageway of the corresponding the respective pivot portion of the plier members.

32. The plier apparatus according to claim 27, wherein said illumination device includes a high intensity while LED light source.

* * * * *